US006324859B1

(12) United States Patent
Tesche et al.

(10) Patent No.: US 6,324,859 B1
(45) Date of Patent: Dec. 4, 2001

(54) INDOOR UNIT OF AN AIR CONDITIONER

(75) Inventors: Carlos Alfonso Tesche, Canoas—RS; Juan Carlos Carne Correa, Porto Alegre—RS, both of (BR)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/485,753

(22) PCT Filed: Jun. 22, 1998

(86) PCT No.: PCT/BR98/00038

§ 371 Date: Feb. 15, 2000

§ 102(e) Date: Feb. 15, 2000

(87) PCT Pub. No.: WO99/67580

PCT Pub. Date: Dec. 29, 1999

(51) Int. Cl.[7] ..... F25D 23/12; F25D 19/00
(52) U.S. Cl. ..... 62/262; 62/263; 62/298
(58) Field of Search ..... 62/262, 263, 298, 62/297, 428, 259.1; 312/236

(56) References Cited

U.S. PATENT DOCUMENTS

| | | | | |
|---|---|---|---|---|
| 4,151,726 | | 5/1979 | Schlueter | 62/285 |
| 4,416,327 | * | 11/1983 | Naksda et al. | 62/262 X |
| 4,733,542 | | 3/1988 | Blair | 62/263 |
| 4,733,543 | * | 3/1988 | Blair | 62/263 |
| 4,951,737 | * | 8/1990 | Tenhundfeld et al. | 62/262 X |
| 5,094,089 | * | 3/1992 | Lail | 62/262 X |

FOREIGN PATENT DOCUMENTS

| | | |
|---|---|---|
| 1915725 | 10/1970 | (DE) . |
| 1558582 | 2/1969 | (FR) . |
| 2071693 | 9/1971 | (FR) . |

* cited by examiner

*Primary Examiner*—Henry Bennett
*Assistant Examiner*—Chen-Wen Jiang

(57) ABSTRACT

A structural framework for an air distribution unit of the type which includes a housing having an evaporator coil supported therein in an air flow path and a fan for effecting air flow along the flow path. The framework includes a main support frame including a bottom section, a vertically extending back section, and a top section extending forwardly from the top of the back section. The back section and the top section have the same width as the bottom section, and the bottom section and the back section each have right and left hand edges. Vertically extending left and right side walls are structurally interconnected at lower edges thereof to the right-hand edges of the bottom section and the back section, respectively. Each of the side walls has a rectangular lower section and an upper triangular section extending from the upper end of the rectangular section. Each of the side walls also has a horizontally extending channel extending the depth of the lower section of the walls and located between the upper end of the rectangular lower section and the base of the triangular section. A planar fan mounting panel having right and left edges is configured to be received in the horizontally extending channels of the side walls. The fan mounting panel has a depth equal to the depth of the bottom of the main support panel.

5 Claims, 10 Drawing Sheets

INDOOR UNIT OF AN AIR CONDITIONER

TECHNICAL FIELD

The invention generally relates to air distribution units of the type commonly used in air conditioning, heating or ventilation systems and, more particularly, to a structural framework for such a unit.

BACKGROUND ART

In many commercial air conditioning, heating and ventilating systems, treated air is discharged into an area to be conditioned through an air distribution or conditioning unit. For example, one general type of air conditioning system, often referred to as a split system, includes separate indoor and outdoor units. The outdoor unit includes a compressor, a heat exchanger and a fan. The indoor unit includes a heat exchanger and a fan. In operation, the indoor fan draws air into the indoor unit, through an inlet thereof, and forces the air over the indoor heat exchanger and then out of the indoor unit, through an outlet opening therein.

The outdoor fan draws air into the outdoor unit, through an inlet, forces that air over the outdoor heat exchanger and then forces that air out of the outdoor unit through an outlet therein. At the same time, a compressor causes a refrigeration fluid to circulate through and between the indoor/outdoor heat exchangers. At the indoor heat exchanger, the refrigerant absorbs heat from the air passing over that heat exchanger, cooling that air. At the same time, at the outdoor heat exchanger, the air passing over the heat exchanger absorbs heat from the refrigerant passing therethrough.

Split type air conditioning units of this type are typically manufactured in a wide range of cooling capacities. Accordingly, the size of the indoor unit can range from a small compact relatively narrow unit up to a wide unit, of substantially the same height as the compact unit. Typically the larger units will include a plurality of air circulating fans.

In manufacturing such units, particularly as the units become larger, the fabrication of certain components, such as those comprising the front cover portion of the unit, become onerous and cumbersome in size. Typically, the larger the unit the more components are required and the more fasteners are required in order to assemble all of the components. It is considered extremely desirable to minimize the number of components required in order to fabricate the indoor units of such an air conditioning system.

DISCLOSURE OF THE INVENTION

A structural framework for an air distribution unit of the type which includes a housing, which defines an air inlet and outlet, and an air flow path therethrough extending between the inlet and the outlet. The unit includes an evaporator coil supported in the housing in the air flow path and a fan for effecting air flow along the flow path. The framework includes a main support frame including a bottom section having a predetermined depth and width, a vertically extending back section, and a top section extending forwardly from the top of the back section. The back section and the top section have the same width as the bottom section, and the bottom section and the back section each have right and left hand edges. Vertically extending left and right side walls each have a lower edge equal in length to the depth of the bottom section and a rear edge less than the predetermined height of the back section. The lower edges and rear edges of the side walls are structurally interconnected to the right-hand edges of the bottom section and the back section, respectively. Each of the right and left side walls has a substantially rectangular lower section having a depth equal to the predetermined depth of the bottom section and an upper end terminating at a height less than the height of the rear edge. Each of the right and left side walls further has an upper triangular section extending from a base overlying the upper end of the rectangular section, and a hypotenuse which extends from a point intermediate the upper end, rearwardly to the upper end of the rear edge. Each of the right and left side walls also has a horizontally extending channel extending the depth of the lower section of the walls and located between the upper end of the rectangular lower section and the base of the triangular section. A planar fan mounting panel having right and left edges is configured to be received in the horizontally extending channels of the right and left side walls. The fan mounting panel has a depth substantially equal to the predetermined depth of the bottom of the main support panel.

BRIEF DESCRIPTION OF THE DRAWINGS

The invention may be better understood and its objects and advantages will become apparent to those skilled in the art by reference to the accompanying drawings, in which.

BEST MODE FOR CARRYING OUT THE INVENTION AND INDUSTRIAL APPLICABILITY

Figure 1:
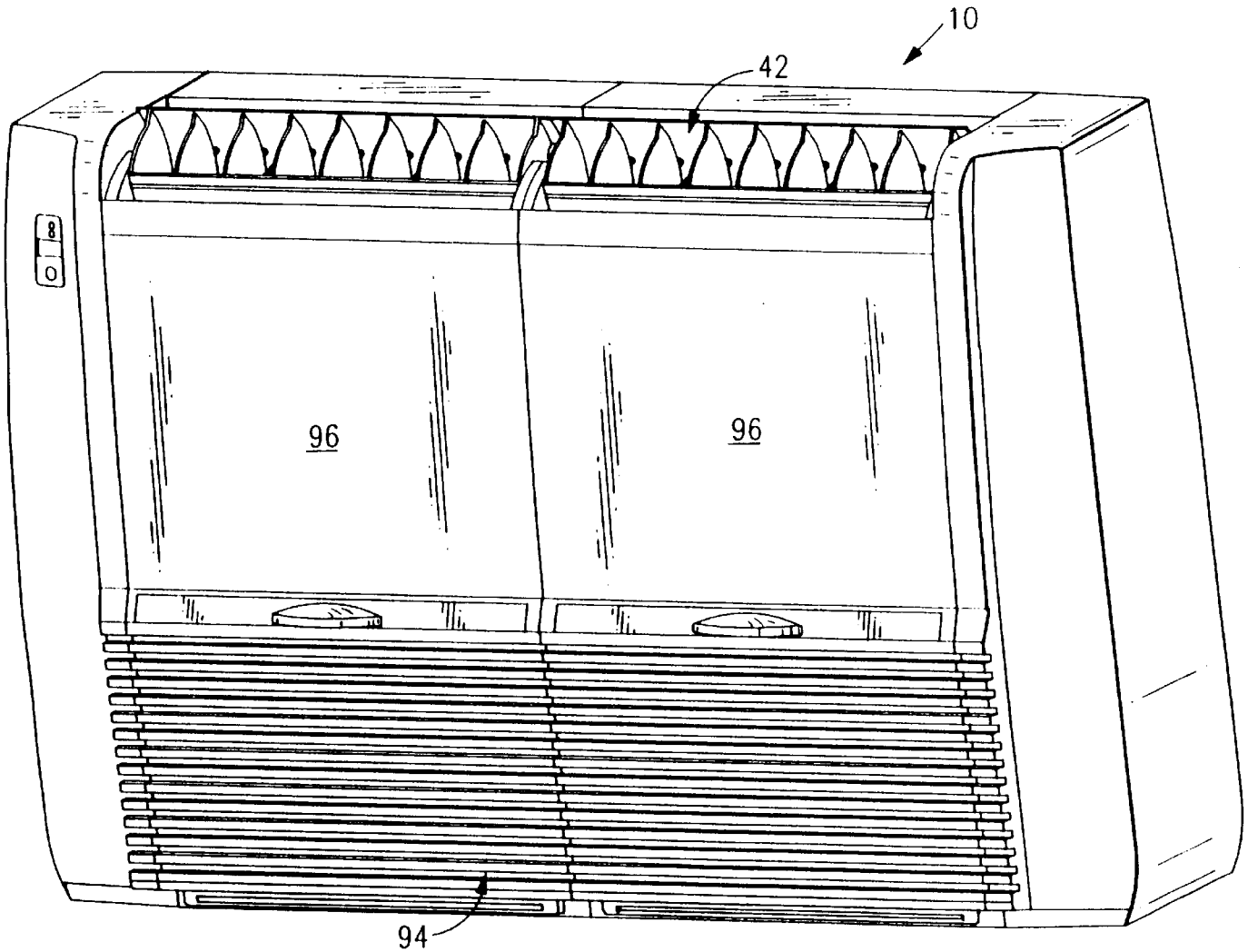
FIG. 1 is a perspective view of the indoor unit of an air conditioner which embodies the features of the present invention.
Figure 8:
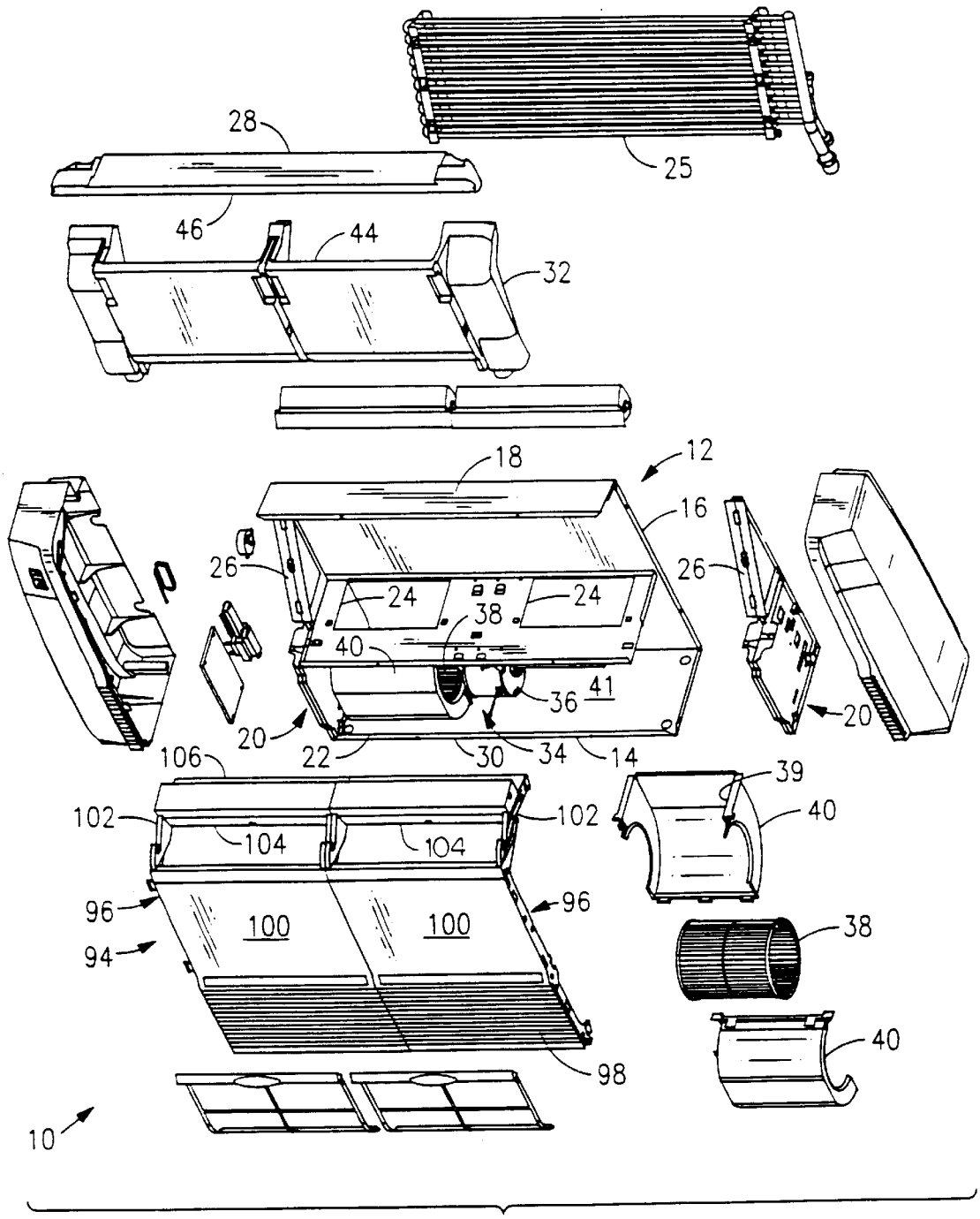
FIG. 8 is a perspective exploded view of the air conditioning unit of FIG. 1.

Looking first at FIGS. 1 and 8, the indoor unit 10 of a split system air conditioning system of the type incorporating a structural framework according to the present invention is illustrated. Briefly, the unit 10 includes a main structural support frame 12, which includes a bottom panel 14, a back panel 16 and a top section 18. Attached to the sides of the back and top panels are structural internal side covers 20. The side covers 20 and the back panel 16 cooperate to support a horizontally extending fan support panel 22, which includes a pair of rectangular openings 24 formed therein. Mounted above the fan support panel 22 on a pair of inclined surfaces 26, defined by the internal side covers 20 is a heat exchanger coil 25.

Mounted under the top section of the main support frame 12 is an upper condensate collection pan 28. Mounted in the front of the unit, under the bottom of the heat exchanger 25, and supported by the front edge 30 of the fan support panel 22, is a lower condensate collection pan 32. A front section of the lower condensate collection pan extends upwardly and is spaced from the heat exchanger coil 25.

Mounted to the lower surface of the fan support panel 22 is a fan assembly 34, which includes an electric motor 36 adapted to drive a pair of centrifugal fans 38, which are each enclosed in a two-piece scroll housing 40. Each of scroll housings 40 defines a rectangular upper air outlet opening 39, which is in air flow communication with the rectangular openings 24 in the fan support panel 22.

As a result of the above-described arrangement of components, when the fan assembly is energized, air is drawn into the region 41 underlying the fan support panel 22 through the open front and is directed upwardly through the rectangular openings 24, through the heat exchanger coil 25 and is discharged through an opening 42 defined by the upper edge 44 of the lower condensate pan 32 and the front edge 46 of the upper condensate pan 28.

Figure 2:
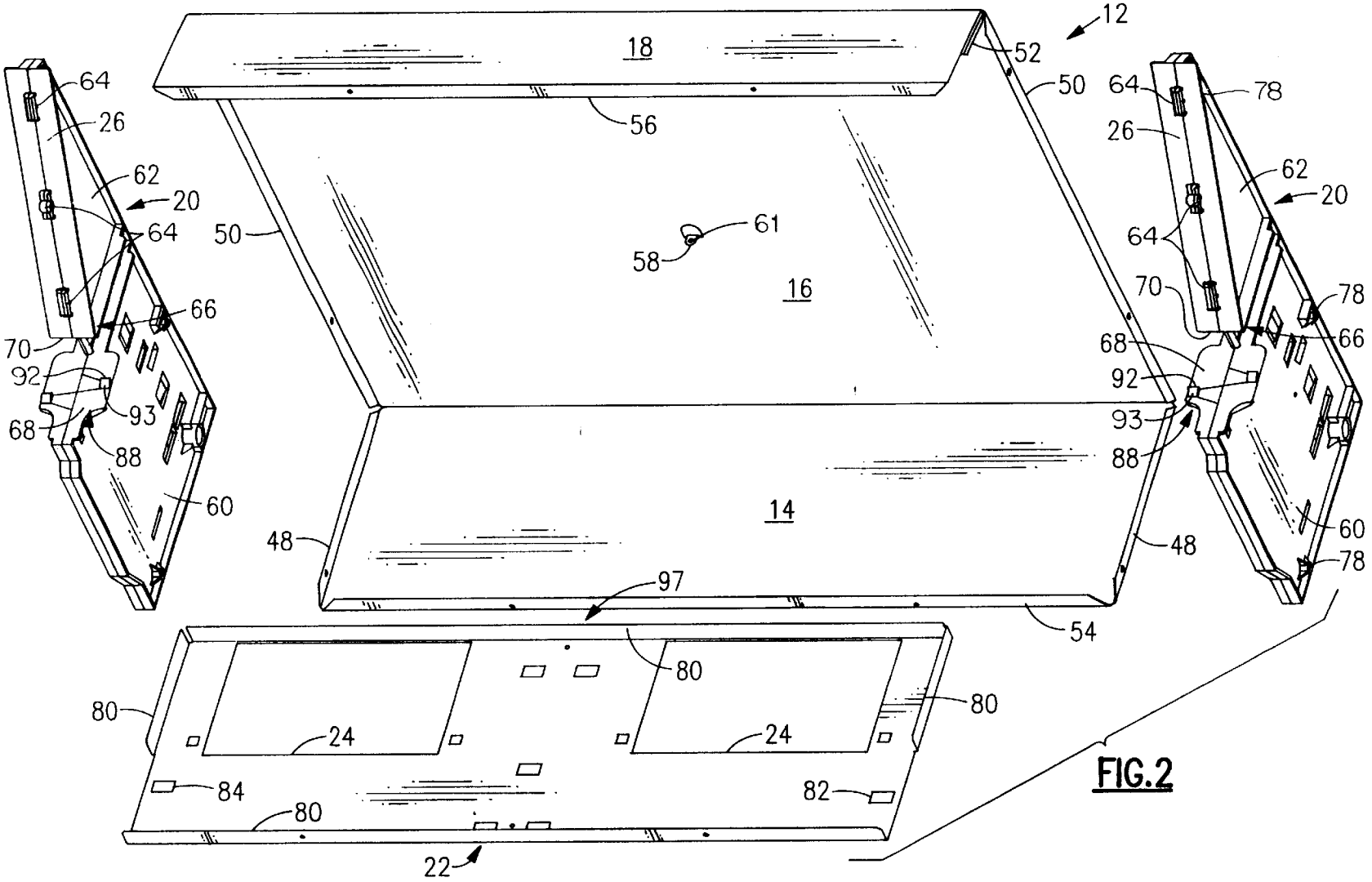
FIG. 2 is a perspective exploded view of several of the major structural components of the air conditioning unit of FIG. 1.
Figure 4:
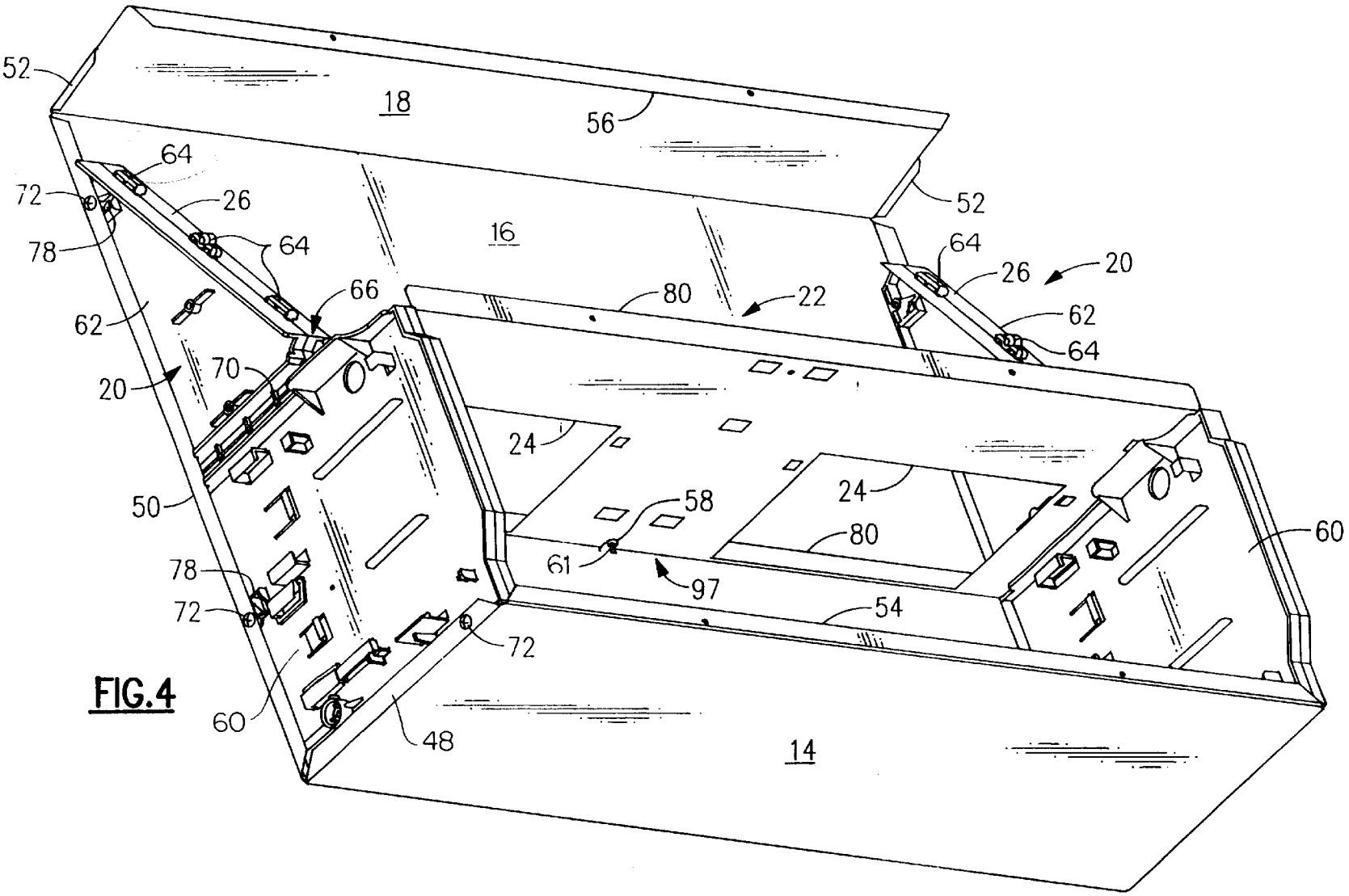
FIG. 4 is a perspective view of the unit illustrated in FIG. 3 as viewed from the bottom thereof.
Figure 5:
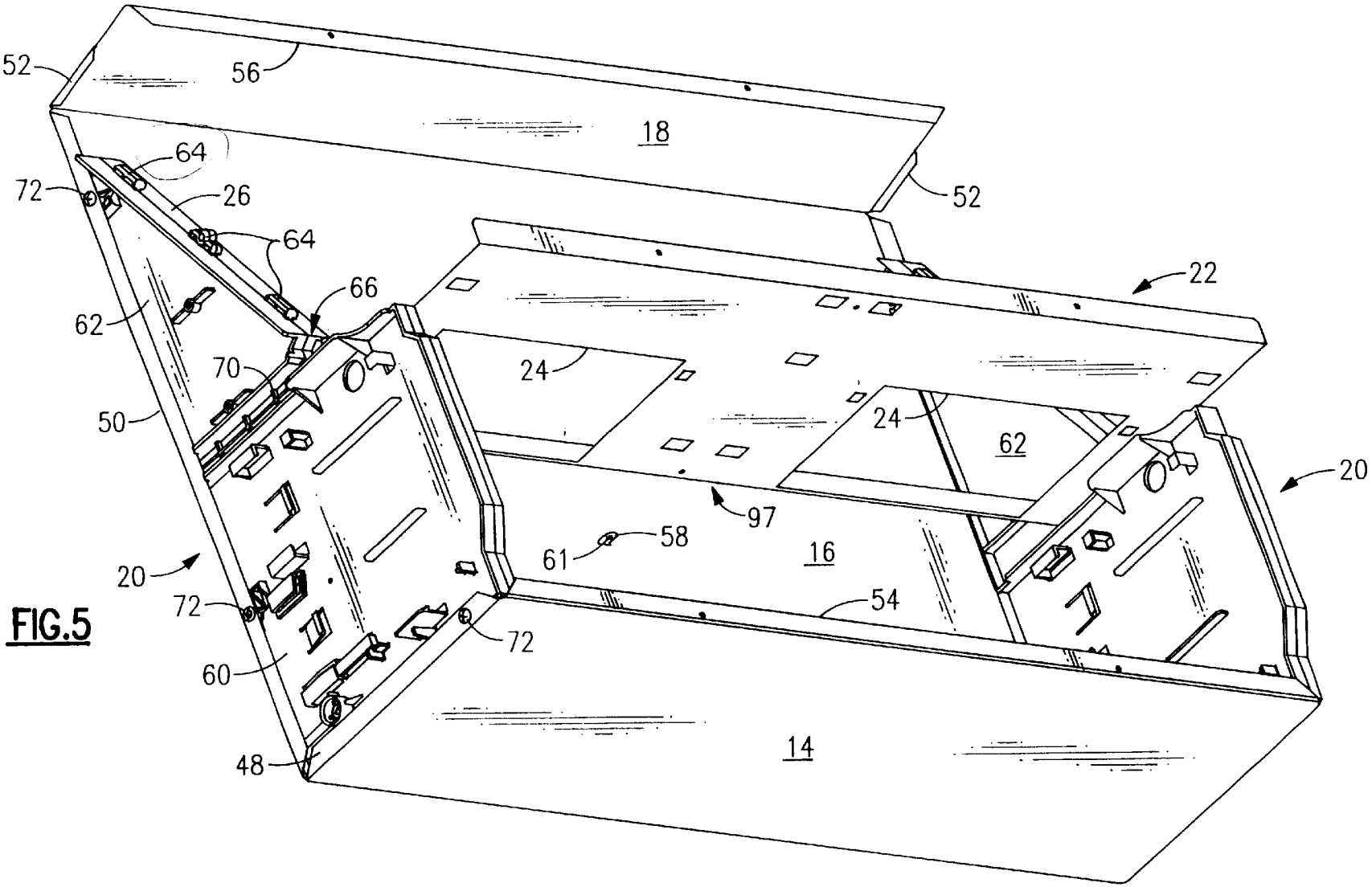
FIG. 5 is a view similar to FIG. 4 with the fan panel partly installed.

FIG. 2 illustrates main structural frame 12, the internal side covers 20 and the fan support panel 22 in their disassembled conditioned. The main structural frame 12 is made from a single sheet of galvanized steel. Each of the sections, bottom 14, back 16 and top 18 of the main frame 12 have the same width, and each is provided with a narrow flange 48, 50 and 52, respectively, on both the right and left-hand sides thereof. Further, the bottom section 14 includes an upwardly extending narrow flange 54 at the front edge thereof, and, the top 18 includes a downwardly extending narrow flange 56 at its front edge. Each of the above-described flanges contributes to the rigidity of the main structural frame 12 and also serves as an attachment point for other structural components of the indoor unit. As best shown in FIGS. 2, 4 and 5, a fan panel support is punched through the back panel 16 to form a horizontally extending tab 58 having an opening 61 therethrough.

The internal side covers 20 are preferably one-piece components molded from a structural plastic material. As illustrated, these components are interchangeable from the left to the right-hand side and, accordingly, only one will be described in detail. The internal side covers 20 include a lower rectangular section 60 having a front to back dimension substantially equal to the front to back dimension of the bottom panel 14. A triangular upper section 62 of the internal side covers have a base dimension less than the depth of the rectangular section 60. The hypotenuse of the triangular sections defines the previously mentioned inclined heat exchanger support surfaces 26.

The heat exchanger 25 is adapted to be structurally supported by outwardly extending protrusions 64 on the inclined surface 26 in a manner forming the subject matter of another patent application and which is not necessary for a full understanding of the present invention. The upper end of the rectangular section 60 and the lower end of the triangle 62 cooperate to define a longitudinal and horizontally extending slot 66, which includes an upwardly facing horizontal surface 68 at the top of the rectangular section 60 and a downwardly facing surface 70 defined by the bottom of the triangular section 62. As will be seen, the slots 66 are adapted to receive the fan support panel 22 therein.

The internal side covers 22 are adapted to be assembled to the main structural frame 12 by placing them inside of the bottom flange 48 and the back flange 50 and thereby attached by three self-threading fasteners 72. The fasteners 72 pass through clearance openings 74 formed in the flanges 48 and 50 and into openings provided in suitably structurally re-enforced sections 78 of the internal side covers 20.

With reference back to FIG. 2, fan support panel 22 is also formed from a single piece of galvanized sheet metal and is provided with upwardly extending narrow flanges 80 on all four sides thereof. The flanges 80 serve to provide rigidity to the fan panel as well as facilitating attachment of the panel to main frame 12 and side cover 20, and attachment of other components thereto. It will be noted that the planar portion of the right hand side of the fan panel is provided with a rectangular opening 82. A similar rectangular opening 84 is provided on the left-hand side of the fan panel positioned somewhat further rearwardly than the opening 82 on the right-hand side.

Assembly of the fan support panel 22 is accomplished by sliding the fan panel 22 into the slot 66 provided in the internal side covers 20 in manner similar to installing a drawer in a cabinet. The installation is illustrated in FIG. 5 and it should be appreciated that the flanges 80 on the right and left-hand sides of the fan panel are substantially the same height as the slots 66 to assure positive retention of the panel therein. Further, as best seen in FIG. 2, the upwardly facing surfaces 68 defining the bottom of the slot 66 are provided with upwardly extending protrusions 88, which present an inclined surface 90 to the fan panel as it is slid into position. The protrusions have an inclined surface 93 at the front thereof and a vertically extending rearwardly facing surface 92 at the back thereof. The protrusions are sized and positioned such that when the fan panel is inserted to its fully installed position, the protrusions extend through the openings 82 and 84 in the fan panel with the rearwardly facing vertical surfaces 92 thereof engaging an edge of the openings thereby preventing the fan panel from moving outwardly from its installed position.

Figure 3:
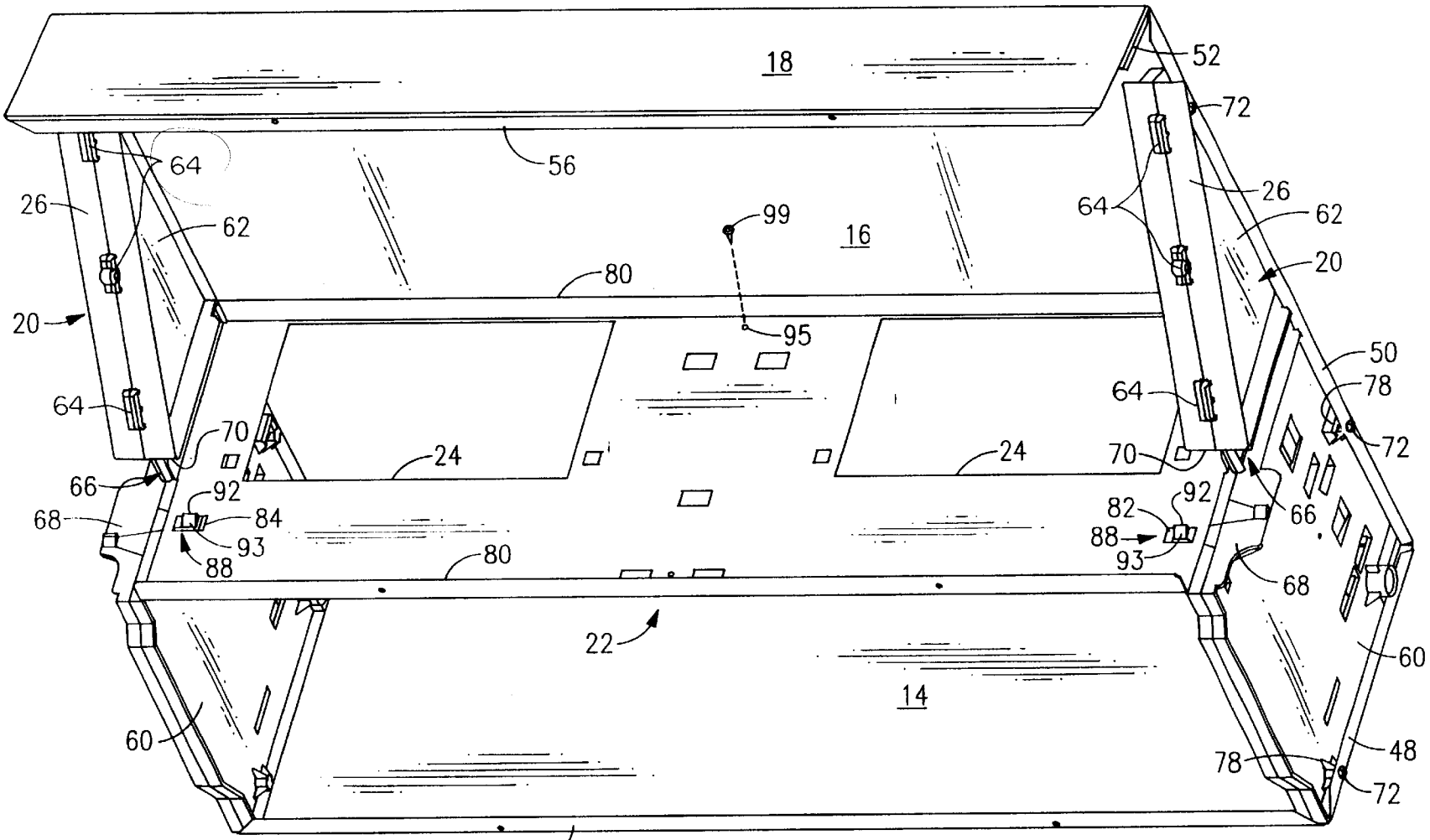
FIG. 3 is a perspective view illustrating the components of FIG. 2 assembled to one another.

Looking now at FIG. 4, it will be noted that with the fan panel in its installed position the back edge 97 thereof overlies the tab 58 formed in the back panel. As best seen in FIG. 3, a single sheet metal screw 99 is installed through an opening 95 in the panel in axial alignment with the opening in the tab 58 to thereby further retain and support the fan panel in its assembled position.

Figure 6:
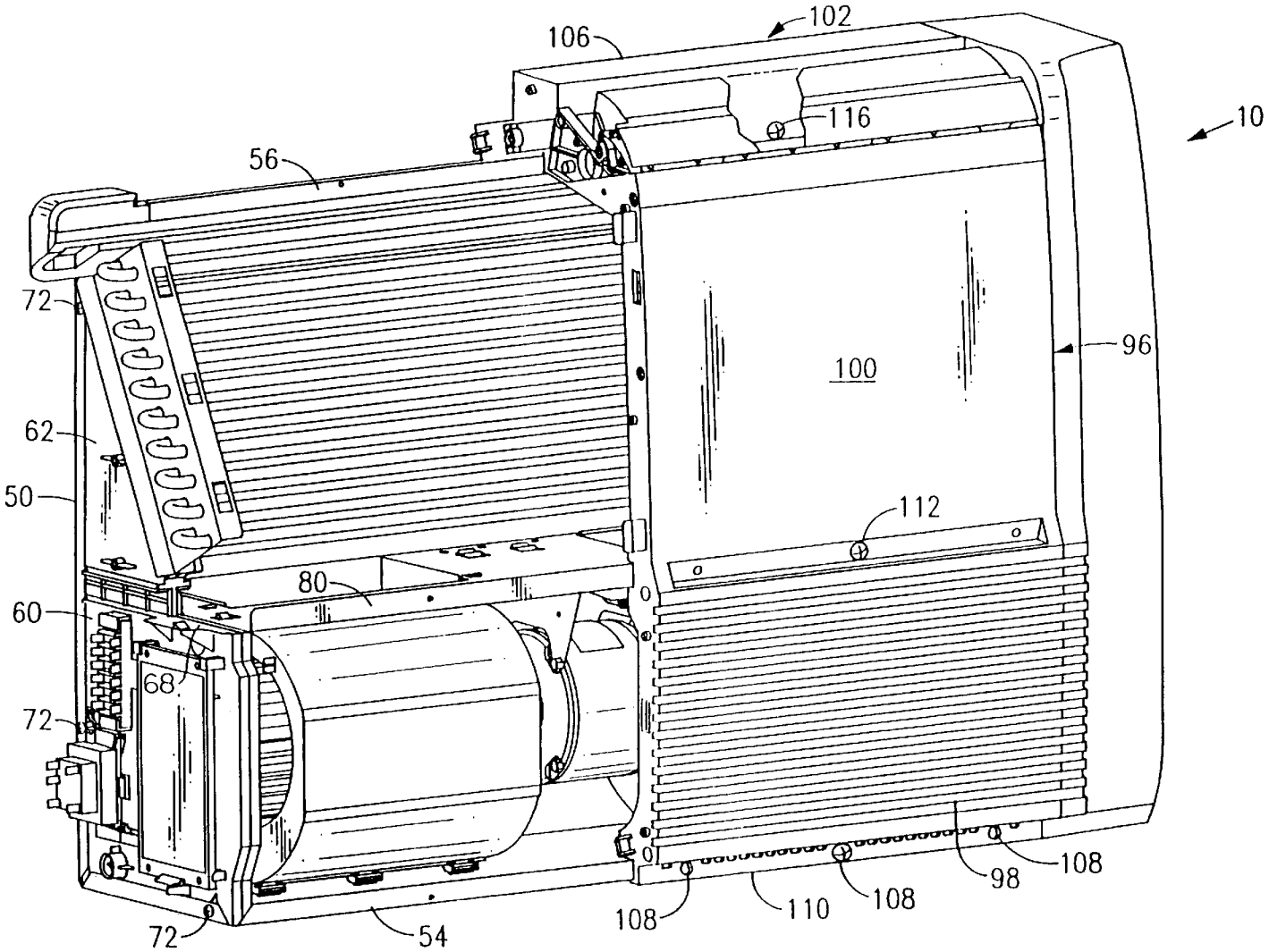
FIG. 6 is a perspective view from another angle of the air conditioning unit of FIG. 1 with one of the modular front panels removed therefrom.
Figure 7:
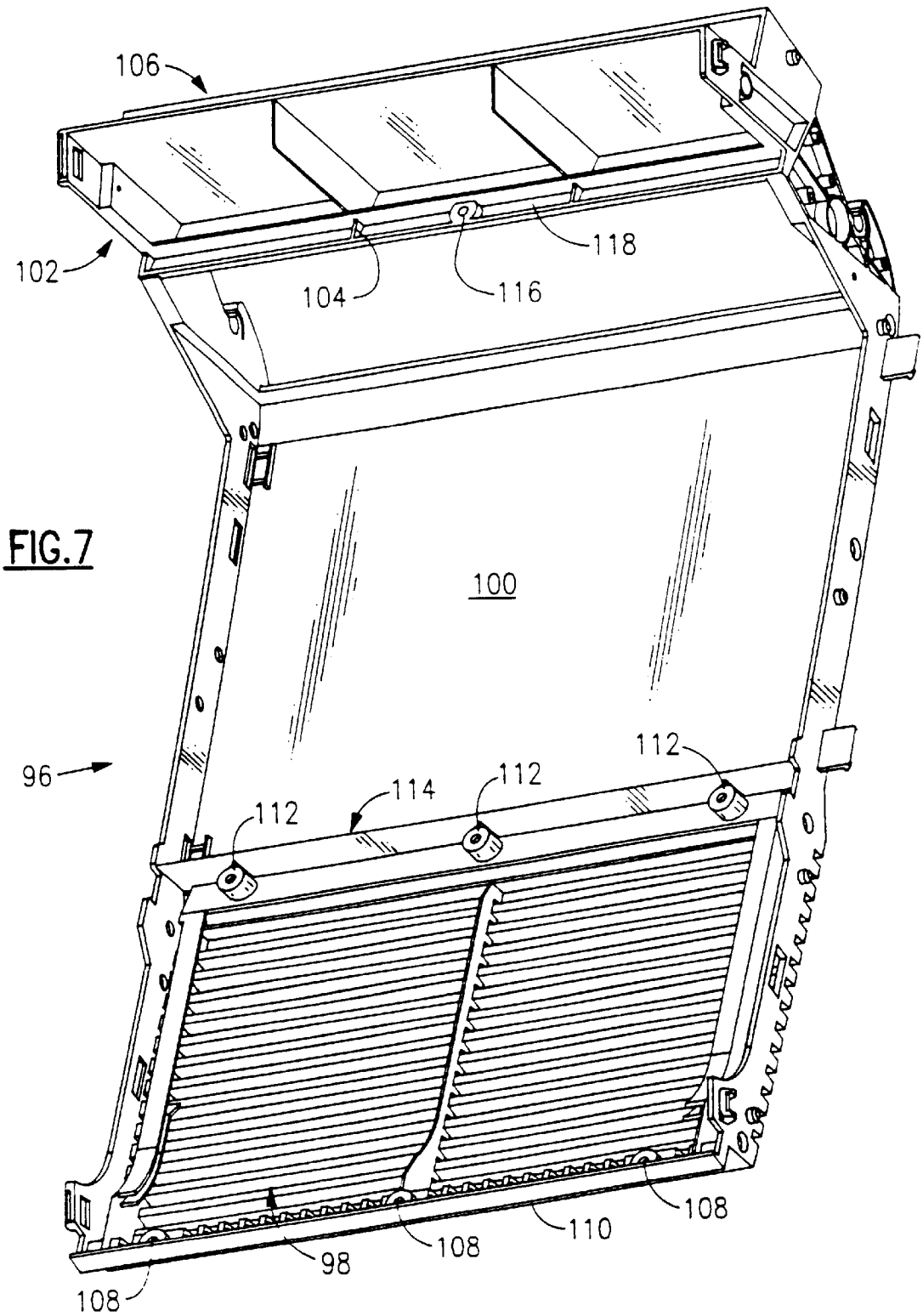
FIG. 7 is a rear view of a modular front panel of the air conditioning unit of FIG. 1.

It should be understood that during assembly of the indoor unit 10, the fan assembly 34 and the scrolls 40 may be assembled to the fan panel prior to its installation, as described above. Following installation of the heat exchanger and the fans, the front cover 94 is assembled to the main structural framework 12 of the unit. The front structural cover for the illustrated unit is best shown in FIGS. 1 and 8 and is made up from an assembly of two separate front cover modules, one of which 96 is illustrated in FIGS. 6 and 7. The manner of attaching the individuals modules 96 to one another to form a multi-unit modular front cover forms the subject matter of an invention covered by another application filed on even date herewith and is not necessary for a full understanding of the present invention.

The front cover modules 96 are made from a single molded piece and comprise a lower louver section 98, a central solid section 100 and an upper horizontally extending section 102. The upper section 102 defines an opening 104 which overlies the discharge opening 42 of the unit and a rearward top cover section 106, which overlies the top 18 of the main structural frame 12. The front cover module 96 is provided with a first series of attachment openings 108 located at the lower edge 110 thereof. A second series of attachment openings 112 is provided at the upper edge 114 of the louvered section 98 and another cover attachment opening 116 is provided near the top thereof in the rear edge 118 of the horizontal section 102 forming the back of the opening 104.

Figure 9A:
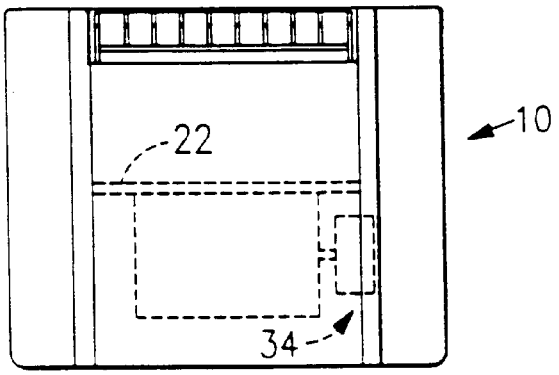
FIGS. 9A–9E illustrate a range of sizes of air conditioning units according to the principles of the invention.
Figure 9B:
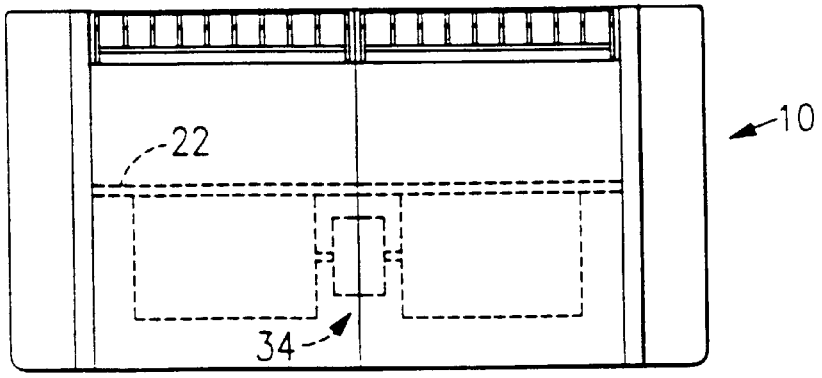
Figure 9C:
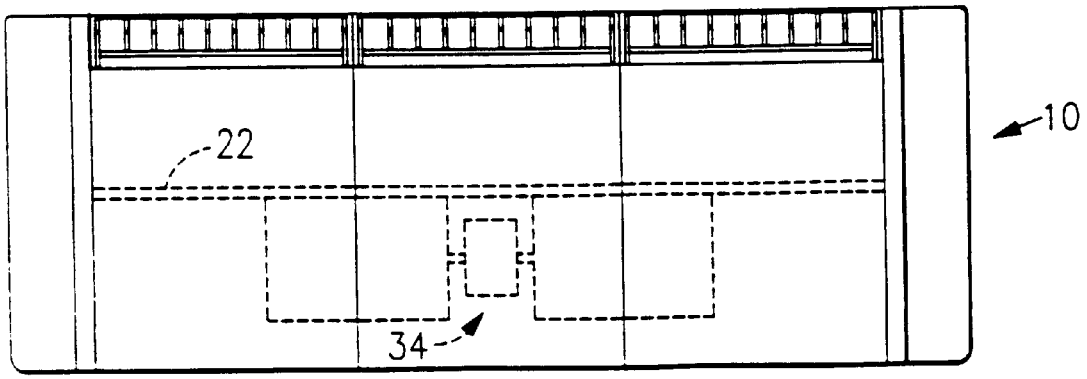
Figure 9D:
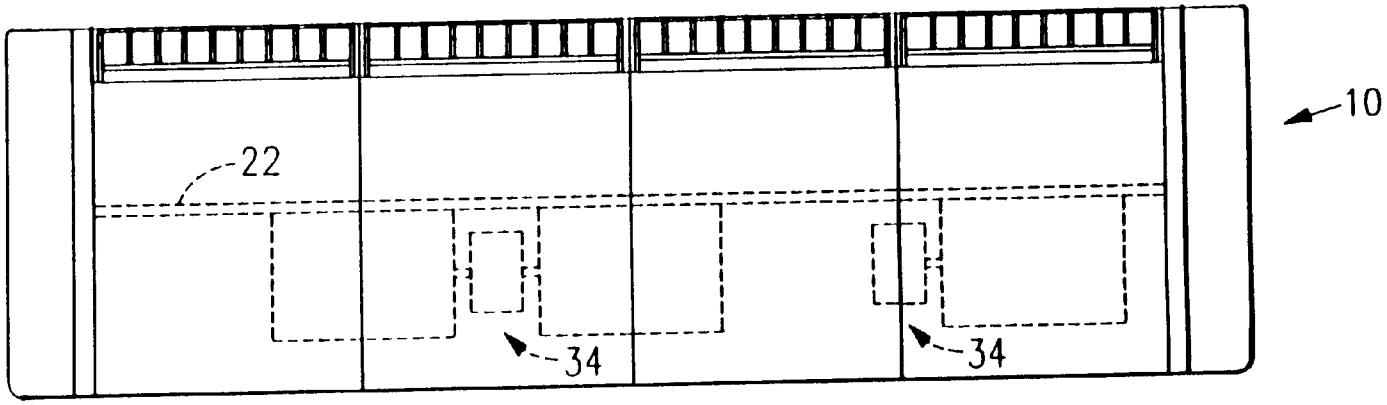
Figure 9E:
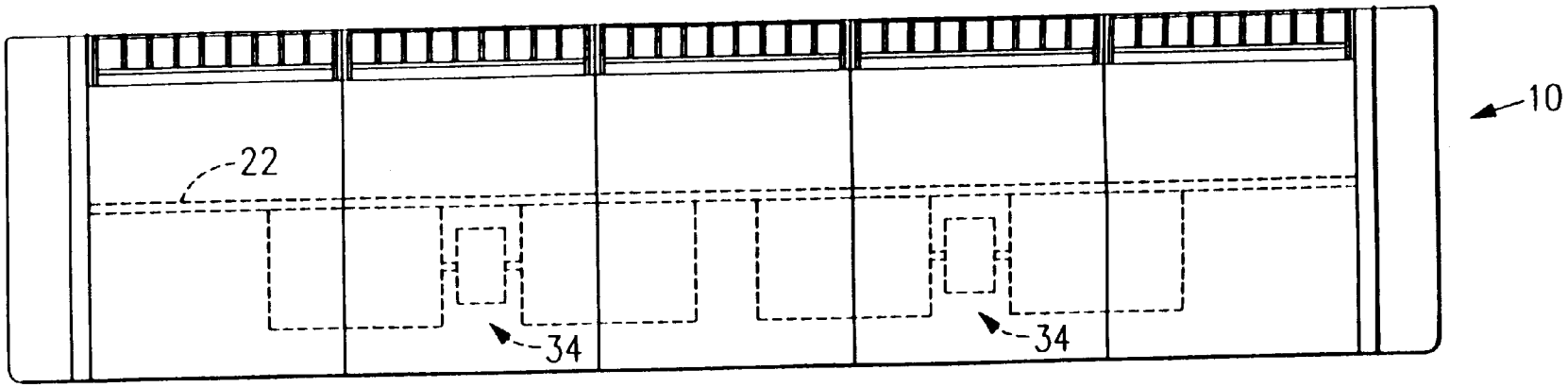

It should be appreciated that while there are three attachment openings provided in the first and second sets 108 and 112 of attachment openings described hereinabove that only the center opening of each set is necessary in the assembly of the cover to a unit of the size described in detail herein. The additional openings are used for attaching the covers to larger sized units such as those illustrated in FIGS. 9C–9E wherein units utilizing up to five front panel modules 96 are illustrated. As is best seen in FIG. 6, a threaded fastener passing through the first opening 108 is received in a mating opening in the front flange 48 of the bottom 14. Likewise, a threaded fastener passing through one of the second set of openings 112 is received in the front flange 80 of the fan panel 22, and a threaded fastener passing through the opening 116 in the top is received in a mating opening in the forward facing flange 52 of the top 18.

It should be appreciated that the basic structural framework of the unit is the same for all of the units depicted in FIGS. 9A–9E. The only differences include the provisions of additional back panel/fan panel support tabs 58. Also the locations and number of fan discharge openings 24 in the fan panel will vary as required for the number of fan assemblies 34.

What is claimed is:

1. A structural framework for an air distribution unit of the type including a housing defining an air inlet, an air outlet, an air flow path therethrough extending from said inlet to said outlet, an evaporator coil supported in said housing in said air flow path, and a fan for effecting air flow along said air flow path and through said evaporator coil, wherein the improvement comprises:

a main support frame including a horizontally extending planar bottom section having a predetermined depth and width, a vertically extending back section, having a predetermined height extending upwardly from the back of said bottom section, and a top section extending forwardly from the top of said back section, a distance less than said predetermined depth of said bottom section;

each of said back section and said top section having the same width as said planar bottom section, each of said bottom section and said back section having right and left-hand edges;

a vertically extending right side wall having a lower edge substantially equal in length to said predetermined depth of said bottom section, and a rear edge having a height less than said predetermined height of said back section, said lower edge and said rear edge being structurally interconnected to the right-hand edges of said bottom section and said back section, respectively;

a vertically extending left side wall having a lower edge substantially equal in length to said predetermined depth of said bottom section, and a rear edge having a height less than said predetermined height of said back section, said lower edge and said rear edge being structurally interconnected to the left-hand edges of said bottom section and said back section, respectively;

each of said right and left side walls having a substantially rectangular lower section having a depth substantially equal to said predetermined depth of said bottom section and having an upper end terminating at a height intermediate the height of said rear edge, each of said right and left side walls further having an upper triangular section extending from a base overlying said upper end of said rectangular section, and a hypotenuse which extends from a point intermediate said upper end, rearwardly to the upper end of said rear edge;

each of said right and left side walls also having a horizontally extending channel extending the depth of said lower section of said walls and located between said upper end of said rectangular lower section and said base of said triangular section; and a substantially planar fan mounting panel having right and left edges thereof configured to be received in said horizontally extending channels of said right and left side wall, respectively, said fan mounting panel having a depth substantially equal to said predetermined depth of said bottom of said main support panel.

2. The apparatus of claim 1 wherein each of said bottom section, said fan mounting panel, and said top section includes a vertically extending longitudinal flange formed at the front edges thereof;

further including a cover configured to enclose the front and top of said air distribution unit, said cover having horizontally extending sections thereof configured to engage each of said longitudinal flanges of said bottom section, said fan mounting panel, and said top section; and means for structurally interconnecting each of said horizontally extending, sections of said cover with the longitudinal flange with which it is engaged.

3. The apparatus of claim 1 wherein the upper end of each of said rectangular lower sections includes a horizontal surface, which defines the bottom of the respective side walls horizontally extending channel;

each of said horizontal surfaces having an upwardly extending protrusion thereon, said protrusions having an inclined surface facing toward the front of said unit and a vertically extending surface facing toward the back of said unit;

said fan mounting panel being configured to be installed in said channels by sliding said edges into said channel from front to back with a portion of said panel overlying and being guided over said protrusions by said inclined surface;

said fan mounting panel further having openings therein position such that one of said protrusions will extend thereinto, when said panel is its final installed position, with said vertically extending surface engaging a mating edge of said opening.

4. The apparatus of claim 3 wherein said fan panel further includes a back edge, which contacts said back panel when said fan panel is in its final installed positioned; and said back panel has a support tab formed integrally therewith which underlies and supports said fan panel adjacent said back edge.

5. The apparatus of claim 4 further including a threaded fastener interconnecting said fan panel and said tab.

* * * * *